US006882317B2

(12) United States Patent
Koskiniemi et al.

(10) Patent No.: US 6,882,317 B2
(45) Date of Patent: Apr. 19, 2005

(54) DUAL ANTENNA AND RADIO DEVICE

(75) Inventors: Kimmo Koskiniemi, Oulu (FI); Jyrki Mikkola, Kempele (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/307,530

(22) Filed: Nov. 27, 2002

(65) Prior Publication Data

US 2003/0098813 A1 May 29, 2003

(30) Foreign Application Priority Data

Nov. 27, 2001 (FI) ..... 20012314

(51) Int. Cl.[7] ..... H01Q 1/38

(52) U.S. Cl. ..... 343/700 MS; 343/725; 343/729; 343/751

(58) Field of Search ..... 343/700 MS, 702, 343/725, 729, 749, 750, 751, 841, 851, 853, 893

(56) References Cited

U.S. PATENT DOCUMENTS

| | | | | |
|---|---|---|---|---|
| 3,681,770 A | | 8/1972 | Alford | 343/815 |
| 4,320,401 A | | 3/1982 | Schiavone | |
| 4,460,899 A | | 7/1984 | Schmidt et al. | 343/841 |
| 5,999,138 A | | 12/1999 | Ponce de Leon | |
| 6,417,809 B1 | * | 7/2002 | Kadambi et al. | 343/702 |
| 6,483,463 B1 | * | 11/2002 | Kadambi et al. | 343/700 MS |
| 6,496,150 B1 | * | 12/2002 | Li et al. | 343/702 |
| 6,560,443 B1 | * | 5/2003 | Vaisanen et al. | 455/73 |
| 6,633,261 B1 | * | 10/2003 | Iwai et al. | 343/700 MS |

FOREIGN PATENT DOCUMENTS

| | | | |
|---|---|---|---|
| EP | 0 247 454 A1 | 12/1987 | |
| EP | 0 847 101 A2 | 6/1998 | |
| FI | 990395 | 2/1999 | H01Q/1/52 |
| WO | 00/51201 | 8/2000 | H01Q/1/52 |
| WO | WO-01/71846 A1 | 9/2001 | |

* cited by examiner

*Primary Examiner*—Shih-Chao Chen
(74) *Attorney, Agent, or Firm*—Darby & Darby

(57) ABSTRACT

An arrangement for enhancing electrical isolation between antennas in antenna structures comprising at least two antennas, and a radio device applying the arrangement. The interfering antenna comprises components causing substantial degradation in radiation characteristics in the operating band of another antenna. For example, a PIFA (310) may comprise, instead of a short-circuit conductor, a conductive structure (312, 313, 314) having a parallel resonance in the operating band of another antenna (320). Mutual interference of radio parts using separate antennas can be made relatively small without electrical isolation arrangements between antenna elements. Moreover, the invention makes antenna filter design easier and reduces disadvantages caused by antenna filters.

18 Claims, 5 Drawing Sheets

DUAL ANTENNA AND RADIO DEVICE

FIELD OF THE INVENTION

The invention relates to an arrangement for enhancing electrical isolation between antennas in antenna structures comprising at least two antennas. The invention also relates to a radio device employing a dual antenna according to the invention.

BACKGROUND OF THE INVENTION

Portable communications devices operating in two or more radio systems have become common in recent years. If such a communications device functions only in one system at a time, it is usually equipped with an antenna that has two operating bands or one band which is wide enough to cover both bands used by the two systems, for example. Two separate antennas may be used if the communications device can function simultaneously in two systems, especially if the frequency bands of the systems are relatively close to one another. With separate antennas, the mutual interference of the systems can be made smaller than with a common antenna. However, the mutual interference is not completely removed because there exists a certain electromagnetic coupling between the antennas. This problem can be in principle alleviated by increasing the distance between the antennas, which, however, will in practice make the structure too large. An interfering transmitter may also be equipped with an antenna filter the attenuation of which increases steeply on that side of the pass band where the operating band of the affected receiver is located. The order of such a filter is high, resulting in higher production costs and problems related to the pass-band attenuation of the filter. All increases in losses between the power amplifier and antenna will result in increased current consumption in the power amplifier and potential heating problems in the device.

Electromagnetic coupling between antennas can also be reduced by arranging electrical isolation between them. FIG. 1 illustrates such a known solution. FIG. 1 shows the antenna end of a transmitter operating according to a first system, and the antenna end of a receiver operating according to a second system. The transmitter includes a series connection of a RF power amplifier PA, transmitting end antenna filter SFI and a transmitting antenna 110. The filter SFI is relatively simple in that its pass-band attenuation is not harmfully high. The receiver includes a receiving antenna 120 which is connected to a receiving end antenna filter RFI which in turn is connected to a low-noise amplifier LNA. The first system is for example GSM1800 (Global System for Mobile Communications) and the second system e.g. GPS (Global Positioning System) in which the receiving frequency is 1575.42 MHz. In that case GPS reception will be susceptible to interference from GSM transmissions because the gap between the GPS receiving frequency and GSM transmission band is only 135 MHz. In FIG. 1 there is a line 105 between the antenna symbols, referring to an arrangement which electromagnetically isolates the transmitting and receiving antennas. Such an arrangement may be e.g. a grounded metal strip placed between the antenna elements. A disadvantage of this solution is that it increases the amount of hardware as well as production costs. Moreover, the directional characteristics of the antennas may suffer.

An object of the invention is to reduce said disadvantages associated with the prior art. An antenna structure according to the invention is characterized by that which is specified in the independent claim 1. A radio device according to the invention is characterized by that which is specified in the independent claim 13. Some advantageous embodiments of the invention are specified in the other claims.

SUMMARY OF THE INVENTION

The basic idea of the invention is as follows: An antenna structure comprises at least two adjacent but separate antennas with different operating bands. An interfering antenna comprises structural parts which cause substantial degradation of radiation characteristics at the operating band frequencies of the other antenna. This reduces interference level in the receiver to which the other antenna is connected. To realize the invention, a PIFA (planar inverted F antenna), for instance, may have, instead of a short-circuit conductor, a conductor structure which has a parallel resonance in the operating band of the other antenna.

An advantage of the invention is that mutual interference of radio parts using separate antennas can be made relatively small without using an arrangement for electrical isolation between the antenna elements. This is based on the fact that the transmission power of the interfering antenna drops in the operating band of the other antenna. Another advantage of the invention is that it makes antenna filter design easier and reduces disadvantages caused by antenna filters. A further advantage of the invention is that an arrangement according to the invention will not affect the directional characteristics of the antennas. A yet further advantage of the invention is that the necessary structural parts can be partly implemented in conjunction with antenna element manufacturing, without extra production stages.

BRIEF DESCRIPTION OF THE DRAWINGS

The invention is below described in detail. The description refers to the accompanying drawings in which.

DETAILED DESCRIPTION

Figure 1:
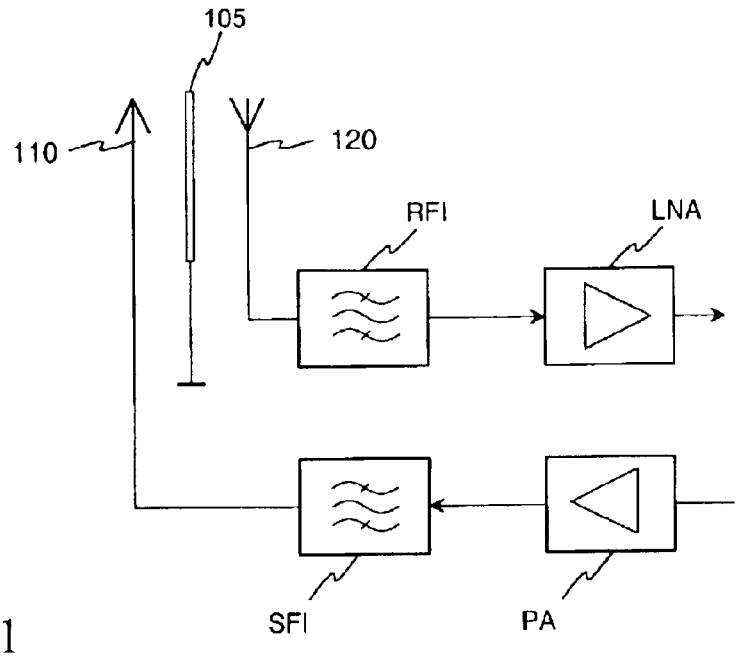
Fig. 1 PRIOR ART
FIG. 1 shows an antenna isolation solution according to the prior art, FIG. 2 schematically shows an antenna isolation solution according to the invention.

FIG. 1 was already discussed in connection with the description of the prior art.

Figure 2:
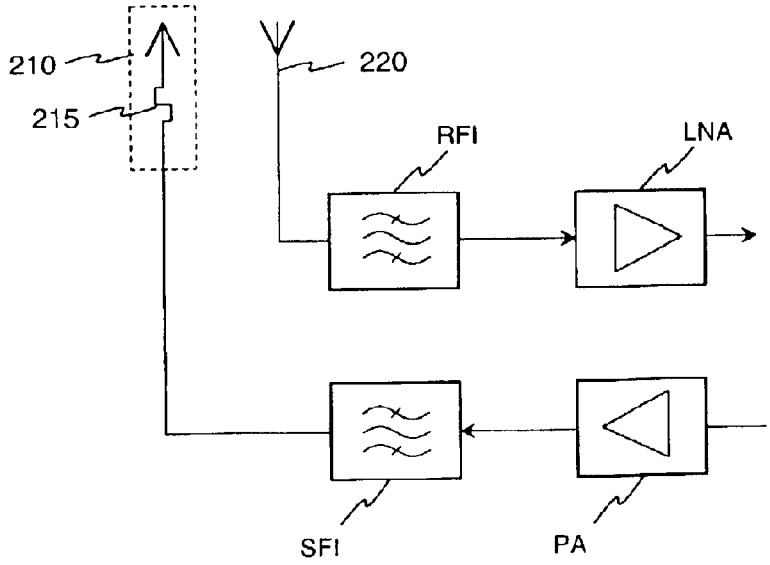

FIG. 2 schematically shows an antenna isolation solution according to the invention. Like in FIG. 1, here, too, are shown the antenna end of a transmitter operating according to a first system, and the antenna end of a receiver operating according to a second system. The difference from FIG. 1 is that the electromagnetic isolation arrangement between the transmitting antenna 210 and receiving antenna 220 is now missing. Instead, FIG. 2 shows symbol 215 referring to an arrangement included in the transmitting antenna structure to provide electromagnetic isolation of the antennas. Isolation is realized such that the arrangement 215 causes substantial deterioration in the radiation characteristics of the transmitting antenna 210 in the operating band of the receiving antenna 220.

Figure 3:
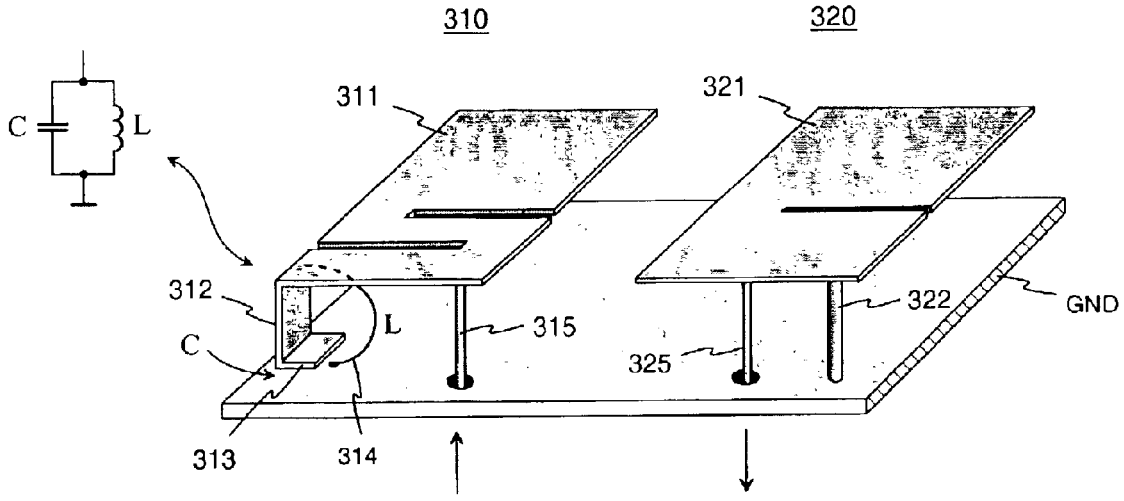
FIG. 3 shows an example of an antenna structure according to the invention.

FIG. 3 shows an example of an antenna structure according to the invention. It includes two PIFA-type antennas where a unitary, relatively massive ground plane GND serves as a ground electrode. The first antenna 310 includes a radiating plane 311. Let us call it a transmitting antenna even though it may also function as a receiving antenna of a bi-directional system. The second antenna 320 includes a radiating plane 321. Let us call it a receiving antenna even though it may also function as a transmitting antenna of a bi-directional system. The receiving antenna 320 also includes a conventional short-circuit conductor 322 and feed conductor 325.

The feed conductor 315 of the transmitting antenna 310 is conventional, too. The short-circuit conductor, instead, is in accordance with the invention. In this example, the short-circuit conductor or, actually, short-circuit arrangement comprises a conductive wire 314 and an extension 312 to the radiating plane 311, directed towards the ground plane, which extension has a conductive plate 313 parallel to the ground plane GND. The conductive plate 313 and ground plane are so close to each other that there is a significant capacitance C between them. The shape of the conductive wire 314 is in this example arcuate. It is connected by one end to the ground plane and by the other end to the radiating plane near the beginning of its extension 312. The conductive wire is so thin that it causes a significant inductance L beside the capacitance C. The resulting parallel resonance circuit is dimensioned so as to have a resonance frequency equal to the center frequency of the reception band of the receiving antenna 320. The impedance of said resonance circuit in the operating band of the transmitting antenna 310 is small, so the antenna radiates and receives well. In the operating band of the receiving antenna the impedance of said resonance circuit is high, whereby the matching of the transmitting antenna is poor and it radiates weakly. Matching is of course degraded alone by the fact that operation is now off from the operating band proper of the transmitting antenna. However, this does not produce sufficient isolation between the antennas if their bands are relatively close to one another. The arrangement according to the invention decidedly enhances the isolation.

FIG. 3 does not show any support structure for the radiating planes. Such a structure may comprise e.g. a dielectric frame along the edges of the plane.

Figure 4:
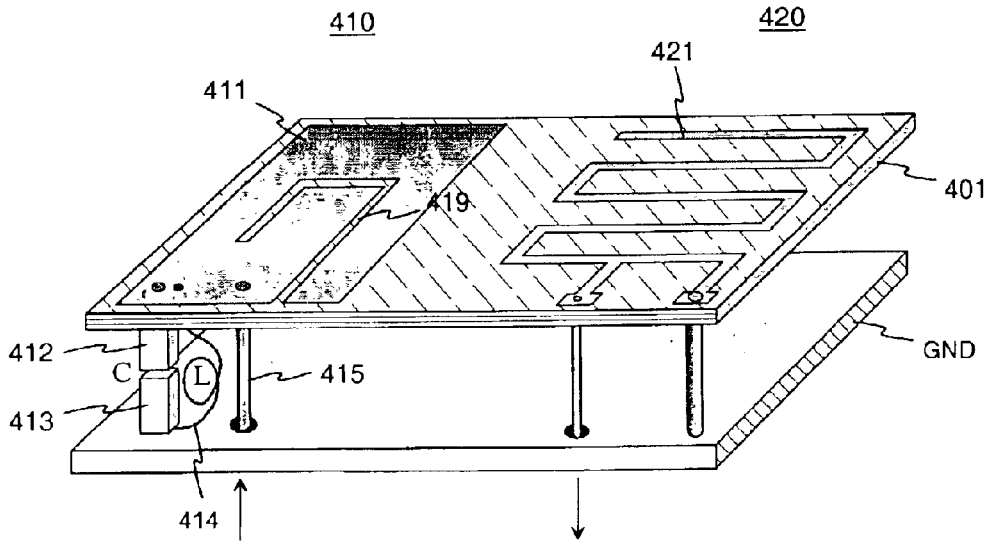
FIG. 4 shows a second example of an antenna structure according to the invention.

FIG. 4 shows a second example of an antenna structure according to the invention. There are two parallel antennas in close proximity to each other, like in FIG. 3. The radiating elements of the antennas are in this case conductive patterns on the surface of a printed circuit board 401. The radiating/receiving element of the receiving antenna 420 is a meandering pattern. The transmitting antenna 410 is a PIFA. In this example is has two bands, because the radiating plane 411 is divided by a nonconductive slot 419 into two branches of different lengths. The transmitting antenna comprises a short-circuit arrangement functioning as a parallel resonance circuit, like the structure in FIG. 3. In this case the short-circuit arrangement includes a first conductive block 412 connected to the radiating plane 411, a second conductive block 413 connected to the ground plane GND, and a conductive wire 414. The first and second conductive blocks face each other. Their facing surfaces are planar and so close to each other that there exists a significant capacitance C between the first and second conductive blocks. The first conductive block may form a single entity with the radiating plane 411 and the second conductive block with the ground plane. The conductive wire 414 starts from the ground plane, makes a single loop, goes through a via in the circuit board, and ends at the radiating plane next to the connection point of the first conductive block. The conductive wire 414 has a certain inductance L.

Figure 5:
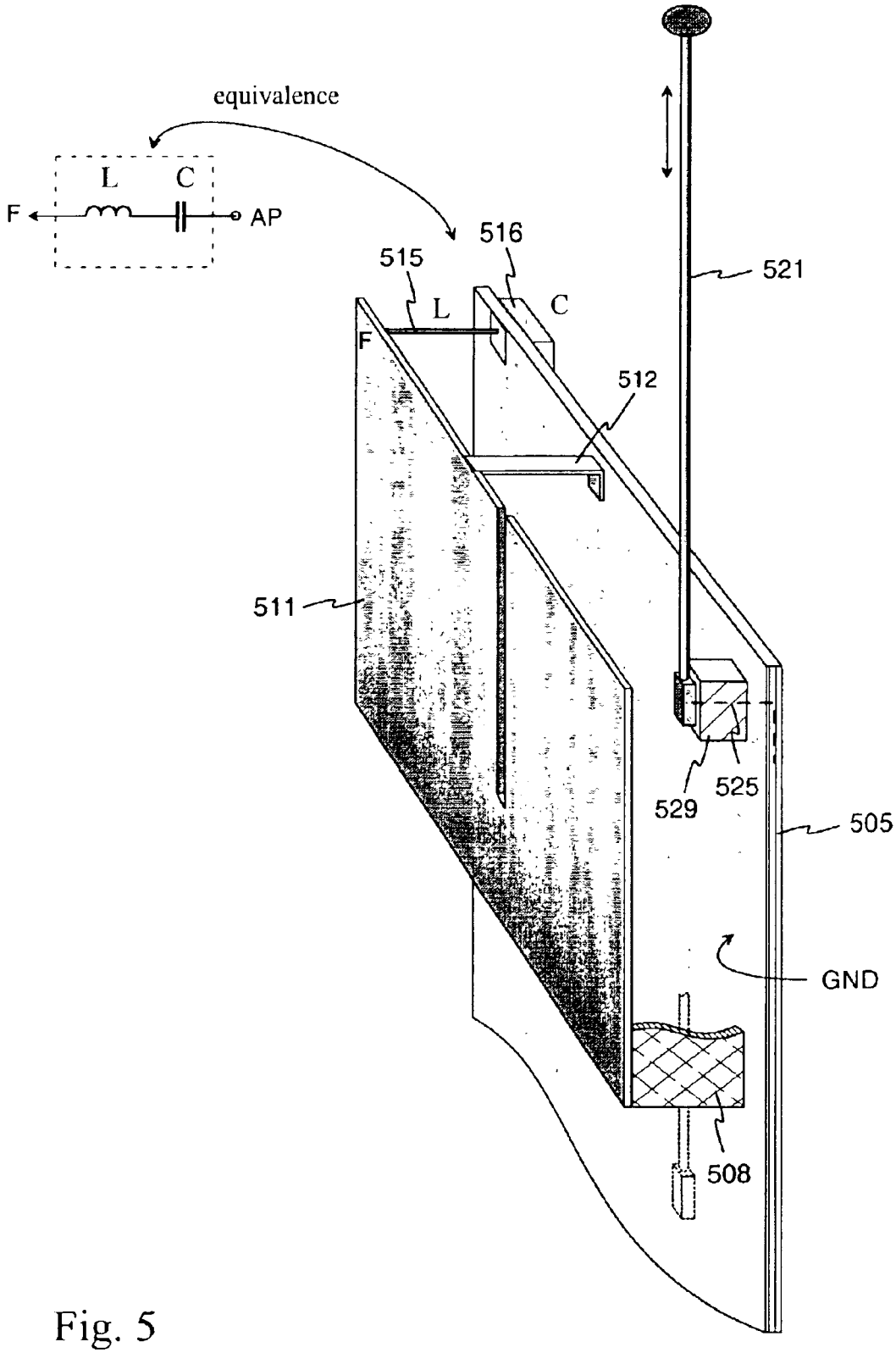
FIG. 5 shows a third example of an antenna structure according to the invention.

FIG. 5 shows a third example of an antenna structure according to the invention. In this example the first, i.e. transmitting, antenna is a PIFA and the second, or receiving, antenna is a monopole the whip element 521 of which can be pushed inside the radio device. The ground plane GND shared by the both antennas is now a conductive plane on a surface of a printed circuit board 505 in the radio device. The short-circuit conductor 512 of the transmitting antenna is in this example conventional. The antenna feed arrangement, instead, is in accordance with the invention. A conventional feed conductor is replaced by a series connection of a discrete capacitor 516 and conductor 515. The capacitor is located on the opposite side of the printed circuit board 505 as seen from the radiating plane 511 of the transmitting antenna. One electrode of the capacitor is connected to the feeding antenna port AP, and one end of the conductor 515 to the feed point F of the radiating plane 511. The thickness of the conductor 515 is chosen such that its inductance L is suitable. The series resonance circuit is designed so that its resonance frequency equals the center frequency of the operating band of the transmitting antenna. The impedance of the series resonance circuit in the operating band of the transmitting antenna is small, so the antenna radiates and receives well. In the operating band of the receiving antenna the impedance of the series resonance circuit is high, whereby the matching of the transmitting antenna is poor and it radiates weakly.

FIG. 5 shows a short part of the frame 508 supporting the radiating plane 511. The support structure for the whip element 521 is not shown except for a dielectric block 529 on the printed circuit board 505 next to the lower end of the extended whip element. The feed conductor 525 of the whip antenna comes through said block into a contact surface on said block 529.

Figure 6:
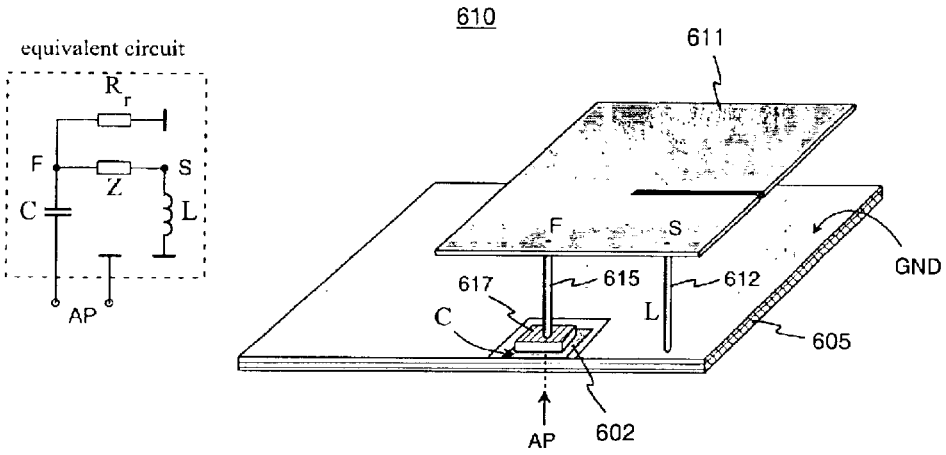
FIG. 6 shows a fourth example of an antenna structure according to the invention, FIGS. 7*a,b* show a fifth example of an antenna structure according to the invention, FIGS. 8*a,b* show a sixth example of an antenna structure according to the invention.

FIG. 6 shows a fourth example of an antenna structure according to the invention. Of the two antennas there is shown only the one the transmission of which tends to interfere with the reception of the other. In this example, too, the transmitting antenna 610 is a PIFA; it is fed at a point F of the radiating plane and it has a short-circuit conductor 612. A conductive layer on the upper surface, or the surface nearest to the radiating plane, of a circuit board 605 in the radio device serves as a ground plane GND. The feeding is capacitive. A "hot" pole of the antenna port AP of the transmitting antenna is galvanically connected to a conductive area 602 on the upper surface of the circuit board 605, which area is insulated from the ground plane. Above this conductive area there is a parallel conductive plate 617, galvanically coupled through conductor 615 to the radiating plane at its feed point F. Between the conductive area 602 and conductive plate 617 there is a certain capacitance C. The gap between the conductors in question may contain air or some dielectric material to increase the capacitance and stabilize the structure. The short-circuit conductor 612 is so thin that its inductance L is significant to the operation of the antenna. Instead of the straight conductor shown here it may naturally be a conductor wound in a coil.

FIG. 6 further shows a simplified equivalent circuit of the antenna 610. Starting from the antenna port AP and following the feed conductor, there is first a capacitance C and feed point F. Between the latter and signal ground there is antenna radiation resistance $R_r$. From the feed point there is a certain, mainly reactive, impedance Z to the short-circuit point S of the radiating plane. Between the short-circuit point and signal ground there is an inductance L. The other pole of the antenna port is connected to the signal ground. The values of the capacitance C and inductance L are chosen such that the transmitting antenna is matched in its own operating band, i.e. the impedance that cab be "seen" in the antenna port is nearly resistive and relatively near the internal impedance of the feeding source. When shifting into the operating band of the other antenna, the matching of the transmitting antenna deteriorates as the radiation resistance goes reactive and, according to the invention, because of the inductance L and capacitance C.

Figure 7A:
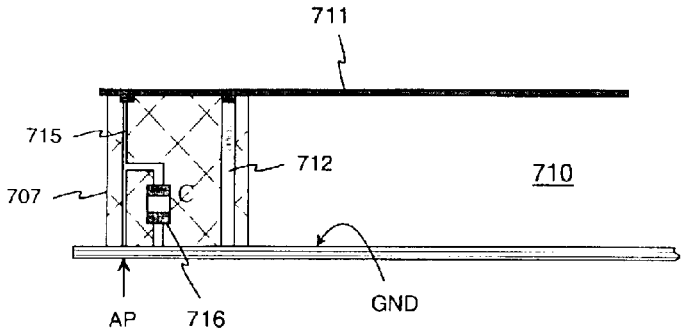
Figure 7B:
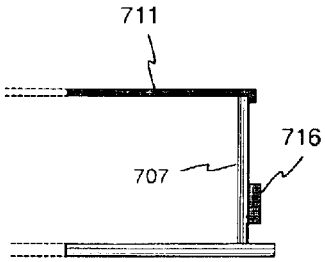

FIGS. 7*a* and *b* show a fifth example of an antenna structure according to the invention. Of the two antennas there is shown only the one the transmission of which tends to interfere with the reception of the other. A transmitting PIFA 710 is shown in FIG. 7*a* from the side of the feed and short-circuit conductors, and in FIG. 7*b* also laterally but 90 degrees horizontally rotated from the position shown in FIG. 7*a*. Between the radiating plane 711 and ground plane GND, extending up to both of these, there is in this example a small circuit board 707. The circuit board 707 includes a straight microstrip 712 which serves as a short-circuit conductor, and a microstrip 715 which serves as a feed conductor. The latter is so thin that it has a significant inductance. The feed strip 715 is here connected by its lower end to the antenna port AP of the antenna 710. An intermediate point in the feed strip is capacitively coupled to ground via a chip capacitor 716 on the circuit board 707. This kind of feed arrangement is designed so that the matching of the transmitting antenna is good in its operating band but relatively poor in the operating band of the receiving antenna.

Figure 8B:
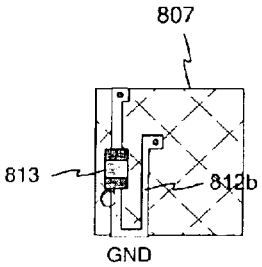
Figure 8A:
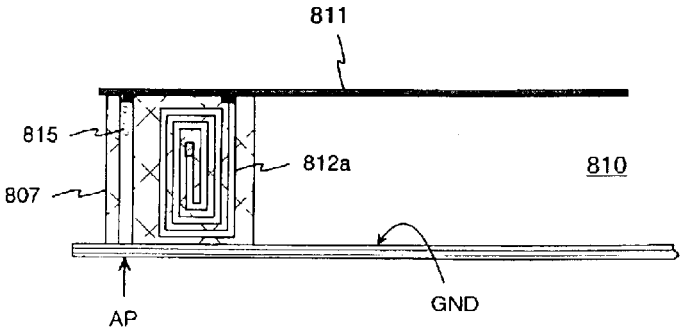

FIGS. 8*a* and *b* illustrate a sixth example of an antenna structure according to the invention. In this case, too, the receiving antenna to be shielded is not shown. A transmitting PIFA 810 is shown in FIG. 8*a* from the side of the feed and short-circuit conductors. Between the radiating plane 811 and ground plane GND, extending up to both of these, there is a small printed circuit board 807. This is in FIG. 8*b* shown from the back, i.e. from inside the antenna 810. The printed circuit board 807 includes a straight feed microstrip 815 and short-circuit strips 812*a* and 812*b*. A first short-circuit strip 812*a* on the front side of the printed circuit board starts from the radiating plane 811 and forms a rectangular "spiral" to increase the inductance. It continues, after a via, on the back side of the printed circuit board in the other short-circuit strip 812*b*. The latter is connected to the ground plane by its lower end. On the back side of the printed circuit board there is also a chip capacitor 813 connected in parallel with a coil formed by the short-circuit strips 812*a,b*. The resulting resonance circuit is designed like in the cases depicted by FIGS. 3 and 4: In the operating band of the transmitting antenna 810 the impedance of the resonance circuit is small but in the operating band of the receiving antenna it is high.

Figure 9:
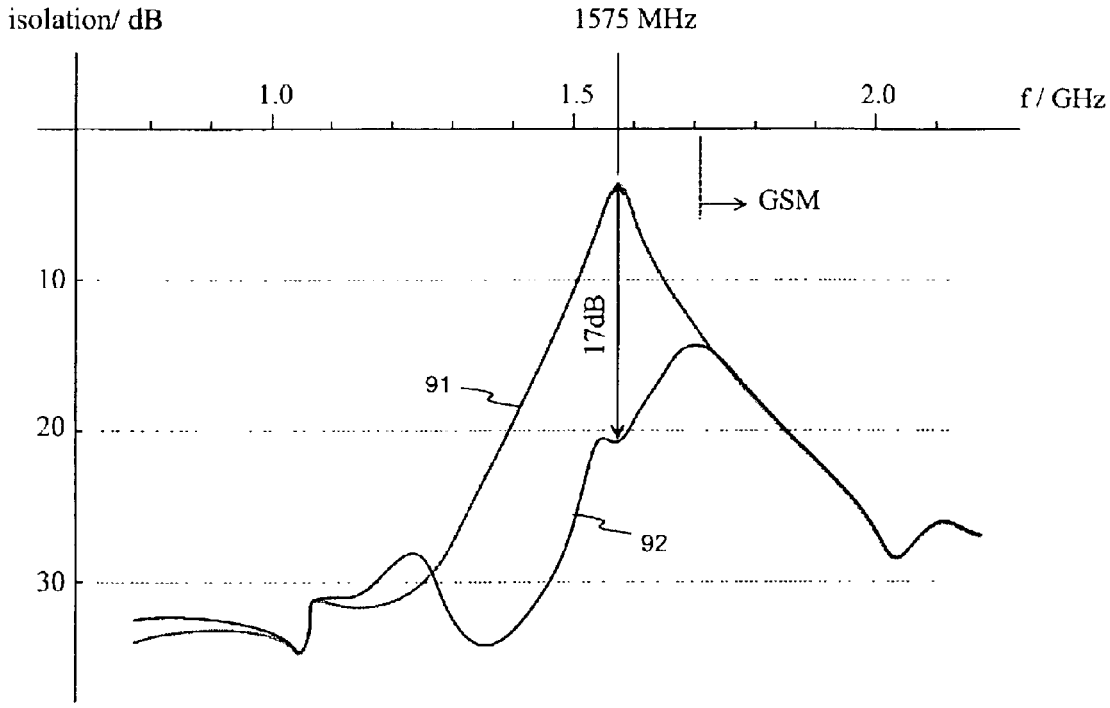
FIG. 9 shows an example of the effect of an arrangement according to the invention on antenna isolation.

FIG. 9 shows an example of the improved electrical isolation that can be achieved between antennas in accordance with the invention. A test signal is fed into an antenna of the GSM1800 system, and a level measurement is done in the output of the antenna of a GPS receiver in the same radio device. Curve 91 represents the isolation attenuation of the antennas with no special GPS reception shielding. The isolation attenuation is of course at its smallest when the frequency of the test signal is 1575.42 MHz, or the frequency used in the GPS system; the attenuation is then only 3.8 dB. Curve 92 shows the isolation attenuation of the antennas when the transmitting antenna has been modified in accordance with the invention in order to shield GPS reception. A resonance circuit in the transmitting antenna raises the isolation attenuation by about 17 dB at the GPS frequency, making it 20.8 dB. A prior-art isolation arrangement corresponding to FIG. 1 will in practice produce an isolation attenuation of about 10 dB, so the improvement from that arrangement, too, is considerable.

Figure 10:
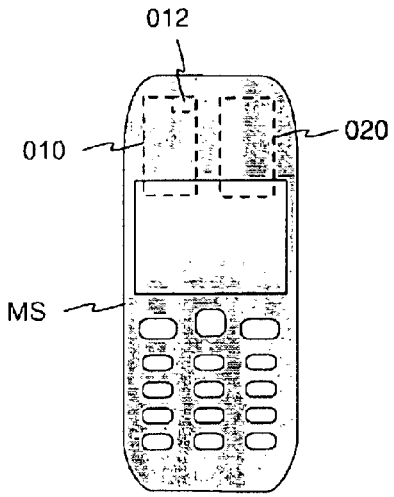
FIG. 10 shows an example of a radio device equipped with an antenna according to the invention.

FIG. 10 shows a radio device MS. It has a first 010 and second 020 antenna. The first antenna includes an arrangement 012 according to the invention.

Above we described a few solutions according to the invention. The invention does not limit the shapes of antenna elements and additional parts according to the invention, nor the method of manufacturing of the antenna. Also both of the two antennas may include an arrangement according to the invention. This may be the case e.g. when a device includes separate UMTS (Universal Mobile Communication System) and WLAN (Wireless Local Area Network) antennas. The inventional idea may be applied in various ways within the scope defined by the independent claim 1.

What is claimed is:

1. An arrangement for enhancing electrical isolation between antennas which comprise a first antenna and a second antenna belonging to one and the same radio device, wherein at least the first antenna comprises structural parts to degrade its matching at frequencies of an operating band of the second antenna.

2. An arrangement for enhancing electrical isolation between antennas which comprise a first antenna and a second antenna belonging to one and the same radio device, wherein at least the first antenna comprises structural parts to degrade its matching at frequencies of an operating band of the second antenna, where the first antenna is a PIFA having a radiating plane and a ground plane, wherein said structural parts to degrade the matching of the first antenna constitute a parallel resonance circuit, which replaces a short-circuit conductor in the PIFA and resonance frequency of which is substantially the same as resonance frequency of the second antenna.

3. The arrangement according to claim 2, said parallel resonance circuit comprising at a point corresponding to short-circuit point of the first antenna a substantially inductive circuit element between the radiating plane and the ground plane, and a capacitive circuit element which substantially increases capacitance in an area corresponding to the short-circuit point.

4. An arrangement for enhancing electrical isolation between antennas which comprise a first antenna and a second antenna belonging to one and the same radio device, wherein at least the first antenna comprises structural parts to degrade its matching at frequencies of an operating band of the second antenna, where the first antenna is a PIFA, said structural parts to degrade the matching of the first antenna constituting a series resonance circuit which replaces feed conductor in the PIFA and resonance frequency of which is substantially the same as resonance frequency of the first antenna.

5. The arrangement according to claim 4, said series resonance circuit comprising a substantially inductive circuit element and a capacitive circuit element forming a capacitance in series therewith.

6. An arrangement for enhancing electrical isolation between antennas which comprise a first antenna and a second antenna belonging to one and the same radio device, wherein at least the first antenna comprises structural parts to degrade its matching at frequencies of an operating band of the second antenna, where the first antenna is a PIFA, said structural parts to degrade the matching of the first antenna constituting an inductive circuit element which replaces short-circuit conductor in the PIFA and a capacitive circuit element which replaces a feed conductor in the PIFA.

7. The arrangement according to claim 1 where the first antenna is a PIFA having a radiating plane and a ground plane, the arrangement comprising a circuit board between the radiating plane and ground plane of the first antenna and said structural parts to degrade the matching of the first antenna being located on the circuit board.

8. The arrangement according to any one of claims 3, 5 or 6, said capacitive circuit element being formed of conductive material in connection with the radiating plane and/or ground plane in the first antenna.

9. The arrangement according to any one of the claims 3, 5, or 6, said capacitive circuit element comprising a discrete capacitor.

10. The arrangement according to any one of claims 3, 5, or 6, said inductive circuit element being formed of conductive material in connection with the radiating plane and/or ground plane in the first antenna.

11. The arrangement according to any one of the claims 3, 5, or 6, said inductive circuit element comprising a coil.

12. The arrangement according to claim 11, said coil being a spiral-like microstrip on a surface of a circuit board.

13. A radio device with a first antenna and a second antenna, wherein at least the first antenna includes structural parts to degrade its matching at the frequencies of an operating band of the second antenna and thus to enhance electrical isolation between said antennas.

14. The arrangement according to claims 7, further comprising a capacitive circuit element formed of conductive material in connection with the radiating plane and/or ground plane in the first antenna.

15. An arrangement for enhancing electrical isolation between antennas which comprise a first antenna and a second antenna belonging to one and the same radio device, wherein at least the first antenna comprises structural parts to degrade its matching at frequencies of an operating band of the second antenna; where the first antenna is a PIFA having a radiating plane and a ground plane, the arrangement comprising a circuit board between the radiating plane and ground plane of the first antenna and said structural parts to degrade the matching of the first antenna being located on the circuit board.

16. An arrangement for enhancing electrical isolation between antennas which comprise a first antenna and a second antenna belonging to one and the same radio device, wherein at least the first antenna comprises structural parts to degrade its matching at frequencies of an operating band of the second antenna; where the first antenna is a PIFA having a radiating plane and a round plane, the arrangement comprising a circuit board between the radiating plane and ground plane of the first antenna and said structural parts to degrade the matching of the first antenna being located on the circuit board; further comprising an inductive circuit element formed of conductive material in connection with the radiating plane and ground plane in the first antenna.

17. The arrangement according to claim 16, further comprising an inductive circuit element comprising a coil.

18. The arrangement according to claim 17, said coil being a spiral-like microstrip on a surface of a circuit board.

* * * * *